US009839335B2

(12) United States Patent
Eriksson

(10) Patent No.: US 9,839,335 B2
(45) Date of Patent: Dec. 12, 2017

(54) CLEANING NOZZLE FOR A VACUUM CLEANER

(71) Applicant: Aktiebolaget Electrolux, Stockholm (SE)

(72) Inventor: Henrik Eriksson, Stockholm (SE)

(73) Assignee: Aktiebolaget Electrolux (SE)

( * ) Notice: Subject to any disclaimer, the term of this patent is extended or adjusted under 35 U.S.C. 154(b) by 310 days.

(21) Appl. No.: 14/354,449

(22) PCT Filed: Oct. 26, 2012

(86) PCT No.: PCT/EP2012/071319
§ 371 (c)(1),
(2) Date: Apr. 25, 2014

(87) PCT Pub. No.: WO2013/060880
PCT Pub. Date: May 2, 2013

(65) Prior Publication Data

US 2015/0208888 A1 Jul. 30, 2015

(30) Foreign Application Priority Data

Oct. 26, 2011 (WO) ..... PCT/EP2011/068743

(51) Int. Cl.
*A47L 9/04* (2006.01)
*A47L 9/02* (2006.01)
*A47L 9/30* (2006.01)

(52) U.S. Cl.
CPC ..... *A47L 9/0477* (2013.01); *A47L 9/02* (2013.01); *A47L 9/30* (2013.01); *A47L 9/04* (2013.01)

(58) Field of Classification Search
CPC ..... A47L 9/02; A47L 9/30; A47L 9/0477
USPC ..... 15/383
See application file for complete search history.

(56) References Cited

U.S. PATENT DOCUMENTS

| | | | |
|---|---|---|---|
| 804,213 | A | 11/1905 | Chaplin |
| 969,441 | A | 9/1910 | Backer |
| 1,231,077 | A | 6/1917 | Scheffler |
| 1,268,963 | A | 6/1918 | Gray |
| 1,412,420 | A | 4/1922 | Polansky |
| 1,757,461 | A | 5/1930 | Losey |
| 1,813,325 | A | 7/1931 | Smith |
| 1,820,350 | A | 8/1931 | Dance |

(Continued)

FOREIGN PATENT DOCUMENTS

| | | | |
|---|---|---|---|
| CA | 2466000 A1 * | 5/2003 | ..... A47L 5/30 |
| CN | 1457742 | 11/2003 | |

(Continued)

OTHER PUBLICATIONS

International Search Report for PCT International Application No. PCT/EP2012/071319 dated Dec. 11, 2012.

(Continued)

*Primary Examiner* — Michael Jennings
(74) *Attorney, Agent, or Firm* — RatnerPrestia

(57) ABSTRACT

A vacuum cleaner nozzle having a rotatable member arranged around a longitudinal axis for picking up particles from a surface to be cleaned, and a cleaning arrangement for removing articles entangled on the rotatable member. The nozzle includes a nozzle cover that at least partly is made of transparent material such that the rotatable member may be visible through the nozzle cover.

17 Claims, 7 Drawing Sheets

(56) References Cited

U.S. PATENT DOCUMENTS 1,907,692 A 5/1933 White
1,965,614 A 7/1934 Sellers
1,999,696 A 4/1935 Kitto
2,032,345 A 3/1936 Cranon
2,625,698 A 1/1953 De Kadt
2,642,601 A 6/1953 Saffioti
2,642,617 A 6/1953 Lilly
2,663,045 A 12/1953 Conway
2,733,000 A 1/1956 Sparklin
2,741,785 A 4/1956 Siebert
2,789,306 A 4/1957 Kath
2,904,818 A 9/1959 Sheahan
2,960,714 A 11/1960 Senne
2,975,450 A 3/1961 Williams
3,268,936 A 8/1966 Fukuba
3,470,575 A 10/1969 Larson
3,536,977 A 10/1970 Porter
3,683,444 A 8/1972 Schaefer
3,722,018 A 3/1973 Fisher
3,862,467 A 1/1975 Krickovich
3,863,285 A 2/1975 Hukuba
3,928,884 A 12/1975 Sutter
4,020,526 A 5/1977 Johansson
4,084,283 A 4/1978 Rosendall
4,171,554 A 10/1979 Tschudy
4,173,054 A 11/1979 Ando
4,193,710 A 3/1980 Pietrowski
4,209,872 A 7/1980 Maier
4,317,253 A 3/1982 Gut
4,352,221 A 10/1982 Revells
4,370,690 A 1/1983 Baker
4,370,777 A 2/1983 Woerwag
4,372,004 A 2/1983 Vermillion
4,373,228 A 2/1983 Dyson
4,398,231 A 8/1983 Currence
4,426,751 A 1/1984 Nordeen
4,573,235 A 3/1986 Baird, Sr.
4,654,924 A 4/1987 Getz
4,702,122 A 10/1987 Richard
4,802,254 A 2/1989 Lahndorff
4,847,944 A 7/1989 Lackner
4,875,246 A 10/1989 MacGregor
4,920,605 A 5/1990 Takashima
4,953,253 A 9/1990 Fukuda
4,989,293 A 2/1991 Bashyam
5,075,922 A 12/1991 Tsuchida
5,115,538 A 5/1992 Cochran
5,121,592 A 6/1992 Jertson
5,203,047 A 4/1993 Lynn
5,243,732 A 9/1993 Koharagi
5,287,581 A 2/1994 Lo
5,394,588 A 3/1995 Kweon
5,452,490 A 9/1995 Brundula
5,482,562 A 1/1996 Abernathy
5,657,503 A 8/1997 Caruso
5,657,504 A 8/1997 Khoury
5,698,957 A 12/1997 Sowada
5,974,975 A 11/1999 Seefried
6,042,656 A 3/2000 Knutson
6,123,779 A 9/2000 Conrad
6,131,238 A 10/2000 Weber
6,170,119 B1 1/2001 Conrad
6,253,414 B1 * 7/2001 Bradd ..... A47L 5/30 15/320
6,266,838 B1 7/2001 Caruso
6,282,749 B1 9/2001 Tajima
6,286,180 B1 * 9/2001 Kasper ..... C11D 3/3905 15/320
6,289,552 B1 * 9/2001 McCormick ..... A47L 5/30 15/324
6,351,872 B1 3/2002 McCormick
6,367,120 B2 4/2002 Beauchamp
6,502,277 B1 1/2003 Petersson
6,539,575 B1 4/2003 Cohen
6,539,577 B1 4/2003 Okuda
6,605,156 B1 8/2003 Clark
6,810,559 B2 11/2004 Mertes
6,883,201 B2 4/2005 Jones
6,892,420 B1 5/2005 Haan
7,143,461 B2 12/2006 Spooner
7,159,276 B2 1/2007 Omoto
7,163,568 B2 1/2007 Sepke
7,171,723 B2 2/2007 Kobayashi
7,228,593 B2 6/2007 Conrad
7,237,298 B2 7/2007 Reindle
7,243,393 B2 7/2007 Matusz
7,293,326 B2 11/2007 Hawkins
7,627,927 B2 12/2009 Blocker
7,631,392 B1 * 12/2009 Meitz ..... A47L 5/30 15/325
7,731,618 B2 6/2010 Burlington
8,087,117 B2 1/2012 Kapoor
8,418,303 B2 4/2013 Kapoor
8,567,009 B2 * 10/2013 Krebs ..... A47L 9/02 15/393
8,601,643 B2 12/2013 Eriksson
8,671,515 B2 3/2014 Eriksson
9,072,416 B2 7/2015 Kowalski
9,186,030 B2 11/2015 Jung
9,314,140 B2 * 4/2016 Eriksson ..... A47L 9/0477
2002/0007528 A1 1/2002 Beauchamp
2004/0172769 A1 9/2004 Giddings
2004/0181888 A1 9/2004 Tawara
2004/0244140 A1 * 12/2004 Joo ..... A47L 9/0416 15/387
2005/0015916 A1 1/2005 Orubor
2005/0015922 A1 1/2005 Lim
2005/0091788 A1 5/2005 Forsberg
2006/0000053 A1 * 1/2006 Lim ..... A47L 9/02 15/415.1
2006/0037170 A1 2/2006 Shimizu
2006/0162121 A1 7/2006 Naito
2006/0272122 A1 12/2006 Butler
2006/0288517 A1 12/2006 Oh
2007/0079474 A1 * 4/2007 Min ..... A47L 5/30 15/353
2008/0052846 A1 3/2008 Kapoor
2008/0289141 A1 11/2008 Oh
2009/0000057 A1 * 1/2009 Yoo ..... A47L 9/06 15/415.1
2009/0100636 A1 * 4/2009 Sohn ..... A47L 5/32 15/368
2009/0229075 A1 * 9/2009 Eriksson ..... A46B 13/006 15/383
2010/0107359 A1 5/2010 Yoo
2010/0205768 A1 8/2010 Oh
2010/0287717 A1 11/2010 Jang
2010/0313912 A1 12/2010 Han
2011/0035900 A1 2/2011 Chae
2012/0013907 A1 1/2012 Jung
2012/0124769 A1 5/2012 Krebs
2013/0007982 A1 1/2013 Yun
2013/0008469 A1 1/2013 Yun
2013/0042429 A1 2/2013 Misumi
2013/0055522 A1 3/2013 Hawkins
2013/0192021 A1 8/2013 Eriksson
2013/0192022 A1 8/2013 Eriksson
2013/0192023 A1 8/2013 Eriksson
2013/0192024 A1 8/2013 Eriksson
2013/0198995 A1 8/2013 Eriksson
2014/0259521 A1 9/2014 Kowalski
2014/0304941 A1 10/2014 Eriksson
2014/0331446 A1 * 11/2014 Eriksson ..... A46B 13/006 15/383
2014/0352104 A1 12/2014 Eriksson
2014/0359968 A1 12/2014 Eriksson
2014/0366300 A1 12/2014 Eriksson
2016/0015233 A1 1/2016 Uphoff

FOREIGN PATENT DOCUMENTS

CN 1593320 3/2005
CN 2746989 12/2005

(56) References Cited

FOREIGN PATENT DOCUMENTS

| | | |
|---|---|---|
| CN | 1816300 | 8/2006 |
| CN | 1816301 | 9/2006 |
| CN | 1883354 | 12/2006 |
| CN | 101310666 | 11/2008 |
| CN | 101686783 | 3/2010 |
| CN | 101984742 | 3/2011 |
| CN | 102334943 | 2/2012 |
| CN | 102462450 | 5/2012 |
| DE | 102010017211 | 12/2011 |
| DE | 102010017258 | 12/2011 |
| EP | 0649625 | 9/1994 |
| EP | 1415583 | 5/2004 |
| EP | 1442693 | 8/2004 |
| EP | 1642520 | 4/2006 |
| EP | 1994869 | 11/2008 |
| EP | 2253258 | 11/2010 |
| EP | 2273906 | 1/2011 |
| EP | 2543301 | 1/2013 |
| FR | 1068296 | 6/1954 |
| FR | 2855742 | 12/2004 |
| GB | 2000963 | 6/1978 |
| GB | 2231778 | 11/1990 |
| JP | 4944560 | 4/1974 |
| JP | 50114057 | 9/1975 |
| JP | 61062426 | 3/1986 |
| JP | 05095868 | 4/1993 |
| JP | 05103740 | 4/1993 |
| JP | 405095868 | 4/1993 |
| JP | 405305044 | 11/1993 |
| JP | 0686743 | 3/1994 |
| JP | 06086743 | 3/1994 |
| JP | 0856877 | 3/1996 |
| JP | 08056877 | 3/1996 |
| JP | 08289862 | 11/1996 |
| JP | 2002165731 | 6/2002 |
| JP | 2003047577 | 2/2003 |
| JP | 2003125991 | 5/2003 |
| JP | 2005160578 | 6/2005 |
| JP | 2005211426 | 8/2005 |
| JP | 2008000382 | 1/2008 |
| JP | 2008188319 | 8/2008 |
| JP | 2008278947 | 11/2008 |
| JP | 2009022644 A | 2/2009 |
| WO | 9210967 | 7/1992 |
| WO | 2008099583 | 8/2008 |
| WO | 2009117383 | 9/2009 |
| WO | WO 2009/117383 | 9/2009 |
| WO | 2010041184 | 4/2010 |
| WO | 2013060365 | 5/2013 |
| WO | 2013060879 | 5/2013 |
| WO | 2013113395 | 8/2013 |
| WO | 2014094869 | 6/2014 |
| WO | 2014177216 | 11/2014 |

OTHER PUBLICATIONS

International Search Report for International Application No. PCT/EP2012/076620 dated Jul. 23, 2013.
Non-Final Office Action dated Apr. 16, 2015 for U.S. Appl. No. 14/354,460.
Notice of Allowance dated Apr. 24, 2015 for U.S. Appl. No. 13/838,035.
Entire patent prosecution history of U.S. Appl. No. 14/702,034, filed May 1, 2015, entitled, "Cleaning Nozzle for a Vacuum Cleaner."
Entire patent prosecution history of U.S. Appl. No. 14/651,059, filed Jun. 10, 2015, entitled, "Cleaning Arrangement for a Rotatable Member of a Vacuum Cleaner, Cleaner Nozzle, Vacuum Cleaner and Cleaning Unit."
Office Action dated May 20, 2015 for U.S. Appl. No. 13/835,691.
Entire patent prosecution history of U.S. Appl. No. 14/730,833, filed Jun. 4, 2015, entitled, "Vacuum Cleaner Agitator Cleaner With Agitator Lifting Mechanism."
Chinese Office Action dated Feb. 29, 2016 for Chinese Application No. 201310485330.X with translation. (pp. 1-9).
Non Final Office Action for U.S. Appl. No. 14/730,833, dated May 19, 2016. (pp. 1-31).
Chinese Office Action dated Apr. 1, 2016 for Chinese Application No. 201280076273.3 with translation. (pp. 1-17).
Chinese Office Action for Chinese Application No. 201310485447.8, dated Feb. 14, 2015 with translation. (pp. 1-5).
Notice of Allowance dated Jun. 24, 2015 for U.S. Appl. No. 13/826,855.
Office Action dated Jul. 7, 2015 for U.S. Appl. No. 13/826,934.
International Search Report for PCT International Application No. PCT/EP2011/068743 dated Jun. 14, 2012.
International Search Report for PCT International Application No. PCT/EP2012/051773 dated Sep. 17, 2012.
International Search Report for PCT International Application No. PCT/EP2012/071318 dated Jan. 3, 2013.
Office Action (with English translation)for Chinese Patent Application No. 200980110915.5 dated Feb. 4, 2013.
Search Report and Written Opinion for PCT International Application No. PCT/US2009/037348 dated May 14, 2009.
Supplemental European Search Report for International Application No. EP09721677 dated Oct. 30, 2012.
Chinese Office Action dated Jul. 1, 2015 for Chinese Application No. 201310485330.X, including English language translation.
Chinese Office Action dated Jul. 14, 2015 for Chinese Application No. 201310479507.5, including English language translation.
Chinese Office Action dated Jul. 3, 2015 for Chinese Application No. 201310485943.3, including English language translation.
Chinese Office Action dated Jun. 30, 2015 for Chinese Application No. 201310485447.8, including English language translation.
International Preliminary Report on Patentability for International Application No. PCT/IB2014/001050 dated Sep. 15, 2015.
International Preliminary Report on Patentability for International Application No. PCT/IB2014/001256 dated Sep. 15, 2015.
Notice of Allowance dated Sep. 10, 2015 for U.S. Appl. No. 13/826,630.
Notice of Allowance dated Oct. 9, 2015 for U.S. Appl. No. 14/354,460.
Notice of Allowance dated Oct. 16, 2015 for U.S. Appl. No. 13/835,691.
International Search Report and Written Opinion for International Application No. PCT/IB2015/001873, dated Feb. 4, 2016.
Notice of Allowance dated Feb. 11, 2016 for U.S. Appl. No. 13/826,934.
Japanese Office Action dated Dec. 15, 2015 for Japanese Application No. 2014-555092 with translation.
Chinese Office Action dated Nov. 27, 2015 for Chinese Application No. 201280068532.8 with translation.
Notice of Allowance dated Dec. 23, 2015 for U.S. Appl. No. 14/354,460.
Notice of Allowance dated Dec. 31, 2015 for U.S. Appl. No. 13/826,630.
Notice of Allowance dated Dec. 15, 2015 for U.S. Appl. No. 13/835,691.
Final Office Action dated Nov. 30, 2015 for U.S. Appl. No. 13/826,934.
International Search Report dated Dec. 10, 2013 for International Application No. PCT/EP2013/059148.
Entire patent prosecution history of U.S. Appl. No. 14/374,119, filed Aug. 25, 2014, entitled, "Cleaning Arrangement for a Nozzle of a Vacuum Cleaner."
Entire patent prosecution history of U.S. Appl. No. 12/405,761, filed Mar. 17, 2009, entitled, "Agitator With Cleaning Features," now U.S. Pat. No. 8,601,643, issued Dec. 10, 2013.
Entire patent prosecution history of U.S. Appl. No. 13/826,400, filed Mar. 14, 2013, entitled, "Brushroll Cleaning Feature With Resilient Linkage to Regulate User-Applied Force," now U.S. Pat. No. 8,671,515, issued Mar. 18, 2014.
Entire patent prosecution history of U.S. Appl. No. 13/826,630, filed Mar. 14, 2013, entitled, "Brushroll Cleaning Feature With Spaced Brushes and Friction Surfaces to Prevent Contact."

(56) References Cited

OTHER PUBLICATIONS

Entire patent prosecution history of U.S. Appl. No. 13/826,855, filed Mar. 14, 2013, entitled, "Brushroll Cleaning Feature With Overload Protection During Cleaning."
Entire patent prosecution history of U.S. Appl. No. 13/826,934, filed Mar. 14, 2013, entitled, "Automated Brushroll Cleaning."
Entire patent prosecution history of U.S. Appl. No. 13/835,691, filed Mar. 15, 2013, entitled, "Vacuum Cleaner Agitator Cleaner With Power Control."
Entire patent prosecution history of U.S. Appl. No. 13/838,035, filed Mar. 15, 2013, entitled, "Vacuum Cleaner Agitator Cleaner With Brushroll Lifting Mechanism."
Entire patent prosecution history of U.S. Appl. No. 14/354,460, filed Jun. 19, 2014, entitled, "Cleaning Nozzle for a Vacuum Cleaner."
Entire patent prosecution history of U.S. Appl. No. 14/354,466, filed Apr. 25, 2014, entitled, "Cleaning Nozzle for a Vacuum Cleaner."
Entire patent prosecution history of U.S. Appl. No. 14/462,956, filed Aug. 19, 2014, entitled, "Vacuum Cleaner Brushroll Cleaner Configuration."
Entire patent prosecution history of U.S. Appl. No. 14/467,697, filed Aug. 25, 2014, entitled, "Actuator Mechanism for a Brushroll Cleaner."
International Search Report and Written Opinion for International Application No. PCT/IB2014/001050, dated Oct. 28, 2014.
International Search Report and Written Opinion for International Application No. PCT/IB2014/001256, dated Oct. 28, 2014.
Japanese Office Action for Japanese Application No. 2014-537645, dated Jun. 14, 2016 with translation, 5 pages.
Japanese Office Action for Japanese Application No. 2014-555092, dated May 24, 2016 with translation, 5 pages.
Chinese Office Action for Application No. 201280058003.X, dated Oct. 9, 2016, 18 pages.
Japanese Office Action for Japanese Application No. 2015548227, dated Oct. 14, 2016, 5 pages.
Non Final Office Action for U.S. Appl. No. 14/888,275, dated Dec. 2, 2016, 24 pages.
Notice of Allowance for U.S. Appl. No. 14/730,833, dated Dec. 2, 2016, 14 pages.
Non Final Office Action for U.S. Appl. No. 14/354,466, dated Jan. 27, 2017, 44 pages.
Non Final Office Action for U.S. Appl. No. 14/467,697, dated Feb. 13, 2017, 50 pages.
Non Final Office Action for U.S. Appl. No. 14/462,956, dated Feb. 22, 2017, 44 pages.
Chinese Office Action for Chinese Application No. 201280058003.X, dated Apr. 6, 2017, 17 pages.
Notice of Allowance for U.S. Appl. No. 14/354,466, dated Aug. 1, 2017, 8 pages.
Notice of Allowance for U.S. Appl. No. 14/462,956, dated Jul. 19, 2017, 10 pages.
Notice of Allowance for U.S. Appl. No. 14/467,697, dated Jun. 30, 2017, 11 pages.
Non Final Office Action for U.S. Appl. No. 14/374,119, dated Jun. 27, 2017, 8 pages.
Non Final Office Action for U.S. Appl. No. 14/651,059, dated Jul. 17, 2017, 8 pages.
Korean Office Action for Korean Application No. 10-2014-7013892, dated Jun. 30, 2017 with translation, 16 pages.
Non Final Office Action for Application No. 14/702,034, dated Oct. 16, 2017, 11 pages.

* cited by examiner

CLEANING NOZZLE FOR A VACUUM CLEANER

This application is a National Stage Application of International Application No. PCT/EP2012/071319, filed Oct. 26, 2012, which claims priority to International Application No. PCT/EP2011/068743, filed Oct. 26, 2011, the entire disclosures of which are expressly incorporated by reference herein.

TECHNICAL FIELD

The present invention relates to a nozzle for a vacuum cleaner comprising a rotatable member and a cleaning arrangement for removing articles entangled to the rotatable member. The invention is intended for battery powered vacuum cleaners as well as mains-operated vacuum cleaners. The nozzle according to the present invention is further envisaged for robotic vacuum cleaners,

BACKGROUND OF THE INVENTION

In vacuum cleaning nozzles provided with a rotatable member, i.e. a rotatable brush roll, it is known that threads, lint, human or animal hairs or any other fibrous material tend to cling or wrap around adhere to the brush roll during operation of the vacuum cleaner. This may impair the functioning of the cleaning nozzle.

In WO2009/117383A2 it is disclosed a cleaning nozzle for a vacuum cleaner provided with a rotary brush having projecting friction surfaces and one or more cleaning members for removing debris that has been wrapped around the rotary brush. The cleaning members are positioned adjacent the rotary brush and are adapted to move between a resting position and a cleaning position, and are arranged to clean the rotary brush during rotation of the brush. Debris that has been collected on a rotary brush is often difficult to remove because it has wrapped tightly around the brush roll and intertwined the bristles. Therefore, a significant force is needed to be able to thread off the entangled threads by means of a cleaning member pressing against a friction member. Such a force may be applied manually by a user of the vacuum cleaner. The electrical vacuum cleaner or motor brush head need to be capable of providing the necessary power to obtain rotation of the brush roll when such force is applied.

A drawback with the disclosed design is that it is difficult for a user to detect whether the brush roll needs to be subject to a cleaning action, since the rotary brush only is visible via a downward-facing opening of the nozzle where dirt and debris are received.

SUMMARY OF THE INVENTION

An object of the present invention is to overcome the above mentioned drawback relating to the difficulty in detecting whether the brush roll needs to be subject to a cleaning action.

According to an aspect of the invention a nozzle for a vacuum cleaner is provided. The nozzle comprises a rotatable member for picking up particles from a surface to be cleaned. The rotatable member is arranged around a longitudinal axis. The nozzle further comprises a cleaning arrangement for removing articles entangled to the rotatable member and a nozzle cover that at least partly is made of transparent material such that the rotatable member may be visible through the nozzle cover.

With a nozzle cover at least partly made of transparent material, the rotatable member may be visible through the nozzle cover. Thereby, the user is able to see if there are a lot of entangled articles present requiring a cleaning action to be performed.

In a further embodiment of the present invention, the nozzle further comprises at least one support surface provided on at least one radially projecting member of the rotatable member, and at least one cleaning member being movable between a resting position in which the cleaning member is arranged at a distance from the support surface and at least one cleaning position in the vicinity of the rotatable member in which the cleaning member, during rotation of the rotatable member, co-operates with at least one segment of the support surface to remove any entangled articles from the rotatable member. Thus, the nozzle cover being at least partly made of a transparent material further has the advantage that a user can determine whether the entangled articles have been removed from the rotatable member after a cleaning action has been performed.

In an embodiment, the at least one radially projecting member is helically arranged along a longitudinal axis of the rotatable member. The helical arrangement ensures proper cleaning of the rotatable member during rotation while at the same time the cleaning interaction is performed within a limited support surface. Thereby, the impact on the rotational speed of the rotatable member is reduced and an effective cleaning action is performed while at the same time normal cleaning operation is maintained.

In yet another embodiment of the present invention, the cleaning member is moved from the resting position to the at least one cleaning position by applying a pressing force to a push button provided on the nozzle at a surface turned towards a user. With the nozzle cover at least partly made of transparent material, the user will be able to see whether the entangled articles have been removed from the rotatable member after a cleaning action has been performed and can operate the push button to move the cleaning member to the resting position.

In embodiments, the cleaning member is connected via a linking mechanism shaft to the push button on the nozzle.

In further embodiments, the nozzle comprises lighting means arranged at the rotatable member for illuminating at least parts of the rotatable member. The lighting means may e.g. be embodied in the form of small lamps or light emitting diodes (LEDs) arranged at an interior of the nozzle. In embodiments, the lighting means may for instance be arranged at a respective end of the longitudinally extending rotatable member or anywhere at the interior of the nozzle mounted to the nozzle housing. In an embodiment, the lighting means are arranged to illuminate the rotatable member when the vacuum cleaner is in operation. Thus, the lighting means will turn on when a user starts the vacuum cleaner. However, a number of different embodiments are envisaged. For instance, the lighting means may be electrically connected to the push button, in which case the lighting means are arranged to illuminate the rotatable member once a pressing force is applied to the push button in order to move the cleaning member to the cleaning position. Thus, the user initiates cleaning of the rotatable member by pushing the push button on the nozzle, thereby making the lighting means illuminate the rotatable member so that the user better can see articles entangled to the rotatable member. In an embodiment, the lighting means are turned on when the push button is fully pressed into an end position.

In a further embodiment the lighting means are turned on when the push button is pressed into an intermediate position.

In still another embodiment the cleaning member comprises a resilient sheet member capable of providing a resilient contact with at least one segment of the at least one support surface in the at least one cleaning position during rotation of the rotatable member. By providing resilient contact for a cleaning action, the necessary power to obtain rotation of a rotatable member, such as a brush roll, is limited compared to earlier solutions. Thereby, proper cleaning function is ensured during cleaning action.

In yet another embodiment, at least one protruding part is arranged on the nozzle at a surface turned towards the surface to be cleaned. When a cleaning action is performed, the protruding part prevents the nozzle from tilting due to the force applied on it.

In embodiments, the rotatable member comprises radial ribs arranged perpendicular to the longitudinal axis of the rotatable member.

In embodiments, the radial ribs extend from the rotatable member to the at least one projecting member creating multiple pockets along the rotatable member. The multiple pockets hinder entangled articles from wandering towards the middle segment of the rotatable member. Thereby, entangled articles are distributed along the length of the rotatable member. Even distribution of the entangled articles is advantageous because the layers of entanglement will be fewer. Fewer revolutions of the rotatable member will then be needed for proper cleaning. The total cleaning time is thereby reduced. Further, the nozzle cover at least partly made of transparent material will facilitate for a user to easily detect articles caught in the pockets.

According to another aspect of the invention, a vacuum cleaner provided with such a nozzle is provided.

Further features of, and advantages with, the present invention will become apparent when studying the appended claims and the following description. Disclosed features of example embodiments may be combined to create embodiments other than those described in the following as readily understood by one of ordinary skill in the art to which this invention belongs, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
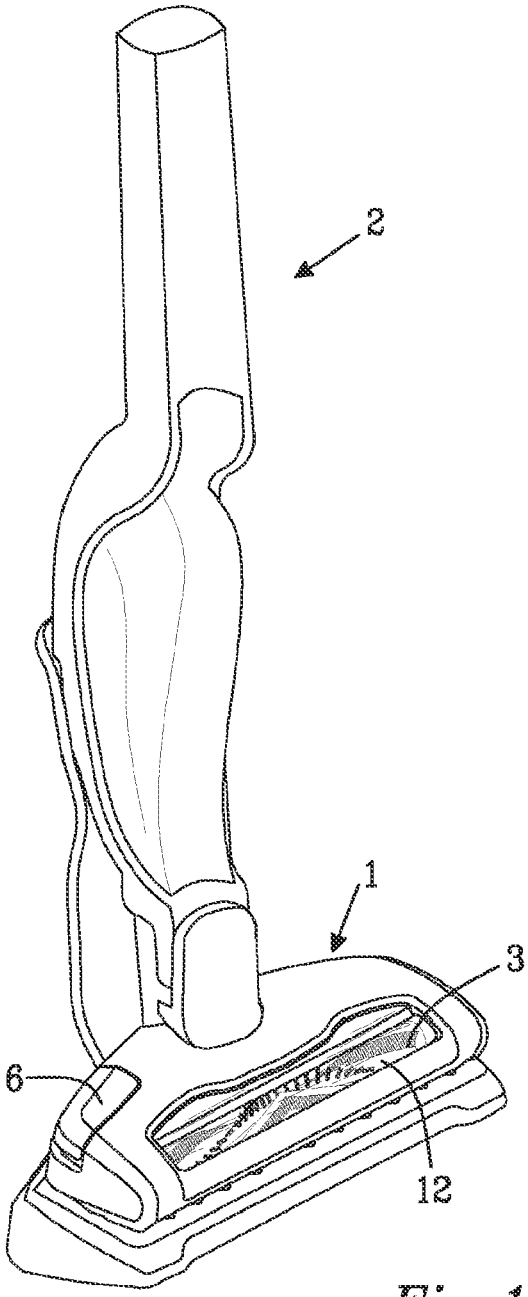
FIG. 1 illustrates a vacuum cleaner according to an embodiment.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 illustrates a vacuum cleaner 2 of an upright model comprising a nozzle 1 provided with a rotatable member 3, like a brush roll, for picking up particles from a surface to be cleaned according to an embodiment of the present invention. The nozzle 1 is further provided with a cleaning arrangement for removing articles entangled to the rotatable member 3. The nozzle 1 comprises a cover 12 that at least partly is made of transparent material such that the rotatable member 3 may be visible through the nozzle cover 12.

Thereby, the user is able to see if there are a lot of articles like hair entangled to the rotatable member 3. The user initiates cleaning of the rotatable member 3 by pushing a push button 6 on the nozzle 1.

Figure 2:
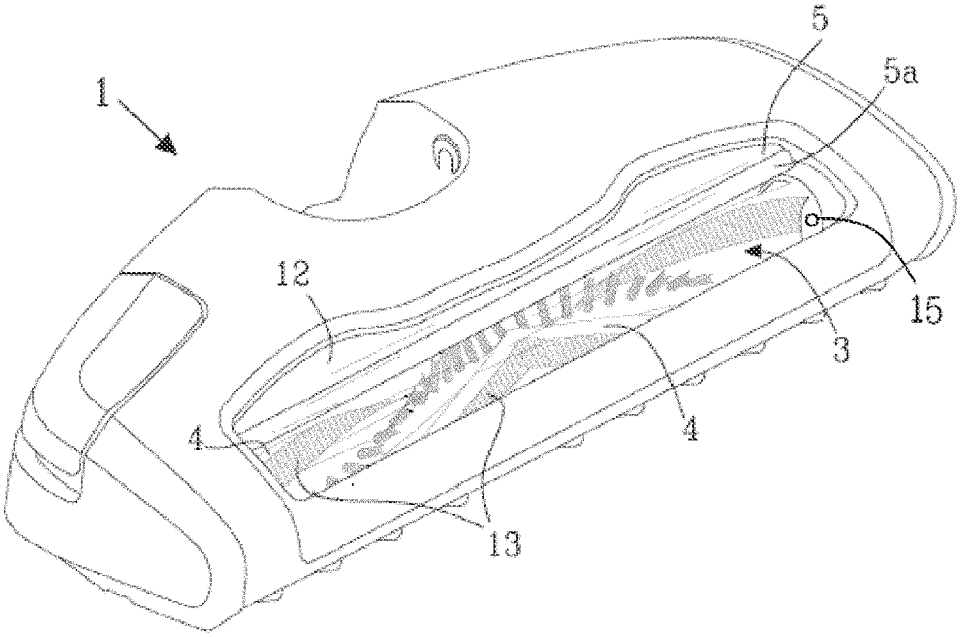
FIG. 2 illustrates a nozzle with a brush roll comprising a projecting cleaning surface in accordance with an embodiment.

FIG. 2 shows a nozzle 1 according to an embodiment more in detail. The cleaning arrangement comprises a cleaning member 5 and a support surface 4 provided on a radially projecting member 13 of the rotatable member 3. In the embodiment shown, two projecting members 13 are helically arranged along a longitudinal axis of the rotatable member 3. Other possible alternatives may be a single helically arranged projecting member 13, or more than two helically arranged projecting members 13. The cleaning member 5 is movable between a resting position in which the cleaning member 5 is arranged at a distance from the support surface 4 and a cleaning position. The cleaning position may be arranged stepwise or gradually, thus enabling the cleaning member 5 to approach the support surface during cleaning action. This might be advantageous for example if a thick layer of entangled articles are present, or if the power available for driving the rotatable member 3 is limited. A push button 6, connected via a linking mechanism 7 shaft to a cleaning member 5, is provided to move the cleaning member 5 between the resting position and the cleaning position.

In a cleaning position, a resilient sheet member 5*a* of the cleaning member 5 co-operates with the support surface 4 during rotation of the rotatable member 3 to remove any entangled articles from the rotatable member 3. The resilient sheet member 5*a* is capable of providing a resilient contact with the support surface 4 in the cleaning position during rotation of the rotatable member 3. Thereby, the possible slow down of the rotational speed of the rotatable member 3 due to the cleaning action will be limited if there is a lot of entangled articles to be removed. The nozzle 1 comprises a cover 12 that at least partly is made of transparent material such that the rotatable member 3 may be visible through the nozzle cover 12. The transparency enables a user to see if a cleaning action is needed or not.

Figure 3:
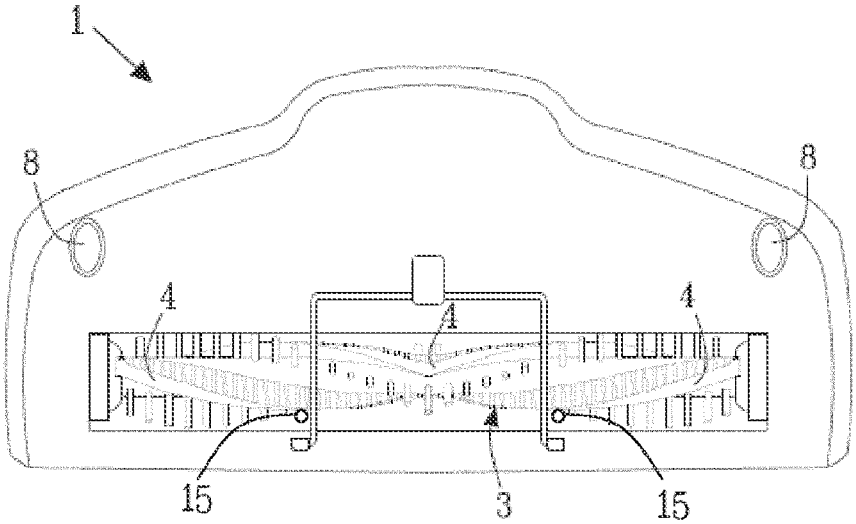
FIG. 3 illustrates the nozzle from underneath.

FIG. 3 illustrates the nozzle 1 from underneath. When the push button 6 is pressed down, the nozzle 1 is prevented from tilting by one or more protruding parts 8 provided underneath the nozzle 1. The protruding part (-s) 8 is arranged on the nozzle 1 at a surface turned towards the surface to be cleaned.

With further reference to FIGS. 2 and 3, in a further embodiment of the present invention, the nozzle 1 comprises lighting means arranged at the rotatable member 3 for illuminating at least parts of the rotatable member. The lighting means may be embodied in the form of small lamps or light emitting diodes (LEDs) 15 arranged at the interior of the nozzle 1. The LEDs 15 may for instance be arranged at a respective end of the longitudinally extending rotatable member 3 as shown in FIG. 2 or any where at the interior of the nozzle 1 mounted to the nozzle housing. In an embodiment, the LEDs 15 arranged to illuminate the rotatable member 3 when the vacuum cleaner 2 is in operation. Thus, the LEDs will turn on when a user starts the vacuum cleaner. However, a number of different embodiments are envisaged. For instance, the LEDs 15 may be electrically connected to the push button 6, in which case the LEDs 15 are arranged to illuminate the rotatable member 3 once a pressing force is applied to the push button 6 in order to move the cleaning member 5 to the cleaning position. Thus, the user initiates cleaning of the rotatable member 3 by pushing the push button 6 on the nozzle 1, thereby making the LEDs 15 illuminate the rotatable member 3 so that the user better can see articles entangled to the rotatable member 3. In an embodiment, the LEDs 15 are turned on when the push button 6 is fully pressed into an end position. In a further embodiment the LEDs 15 are turned on when the push button 6 is pressed into an intermediate position.

Figure 4A:
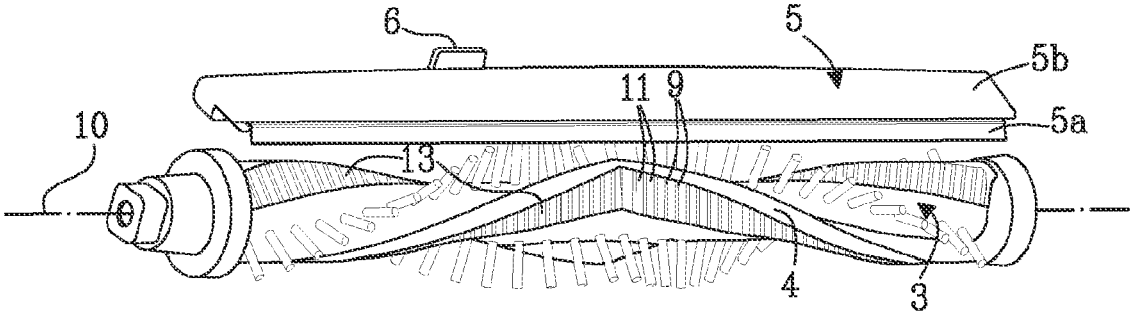
FIGS. 4*a-d* illustrate a cleaning arrangement for the brush roll of the nozzle according to embodiments.
Figure 4B:
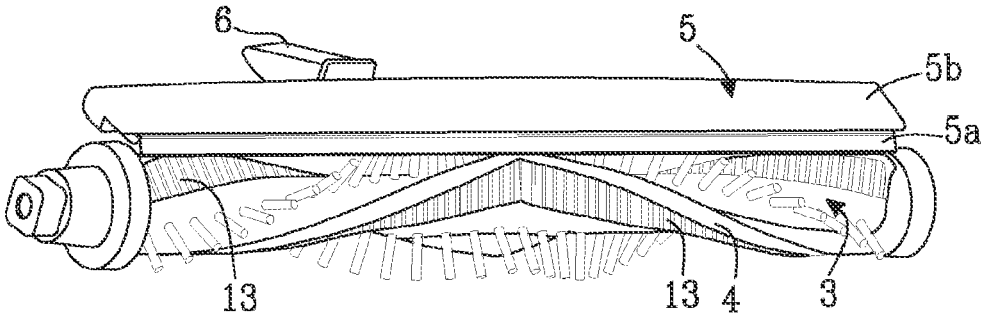

FIGS. 4*a-b* illustrate a resting mode and a second cleaning mode of the cleaning arrangement for a brush roll of the nozzle according to an embodiment. The cleaning member 5 is pivotally arranged via a longitudinal bar 5*b* above the rotatable member 3 such that the cleaning member 5 is pivoted from the resting position above the rotatable member 3 to a cleaning position adjacent the support surface. The length of the cleaning member 5 is preferably the same as the length of the brush roll that is covered by the support surface 4. Two radially projecting members 13 are helically arranged along a longitudinal axis 10 of the rotatable member 3. The cleaning member 5 comprises a longitudinal bar 5*b* holding a resilient sheet member 5*a*. The cleaning member 5 is arranged along a longitudinal axis 10 of the rotatable member 3. The resilient sheet member 5*a* has preferably a thickness in the range of 0.2-0.8 mm. It is of importance to choose a suited material for the resilient sheet member 5*a*. The material will, over time, get worn and loose its original tearing ability. To be wear resistant relatively hard spring steel may be used. The edge of the cleaning member 5 that will be in contact with the support surface need to be relatively sharp in order to effectively remove entangled articles. By shearing, or punch pressing the spring steel, one of the edges of the sheared surface will be rounded while the other will have an edge burr. By punch pressing the cleaning member 5 one edge of the cut surface will be sharper than the other. By shearing, or punch pressing, there will be as mentioned above, an edge burr at the cleaning member 5 edge. If the edge burr is minimized this will create a sharp edge suited for cleaning entangled articles from the brush roll. As an alternative to the above mentioned edge burr, the edge of the cleaning member 5 may be sharpened by machining. Thereby, improved tolerance of the sharp edge is achieved.

Figure 4C:
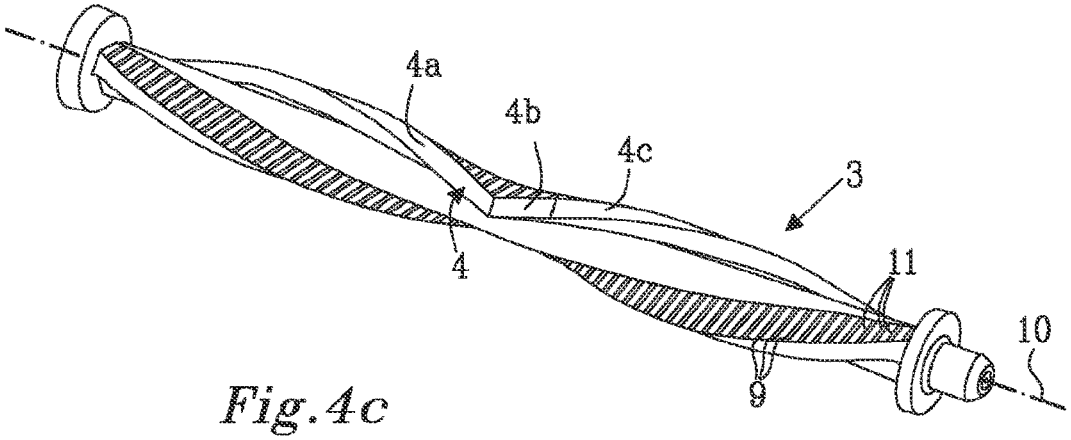

FIG. 4*c* illustrates a rotatable member 3 shown as a brush roll provided with a support surface 4 with a plurality of segments 4*a*, 4*b*, 4*c*. Each of the segments 4*a*, 4*b*, 4*c* are arranged at an individual radius in relation to the longitudinal axis 10. The radius of the segments is in the shown embodiment gradually changed whereby the segments form a continuous support surface 4. Alternatively, the radius may be changed in steps whereby three separate support surfaces with different radius are provided. The radius of the segment 4*a* is chosen to enable cleaning contact between the cleaning member, when in a cleaning position, and the surface segment 4*a*. The radius of the segment 4*c* is chosen to enable a small distance between the cleaning member 5, when the cleaning member 5 is in cleaning position, and the segment 4*c*. The segment 4*b* is provided with a gradually changing radius providing a smooth transition from the radius of segment 4*a* to the radius of segment 4*c*.

Figure 4D:
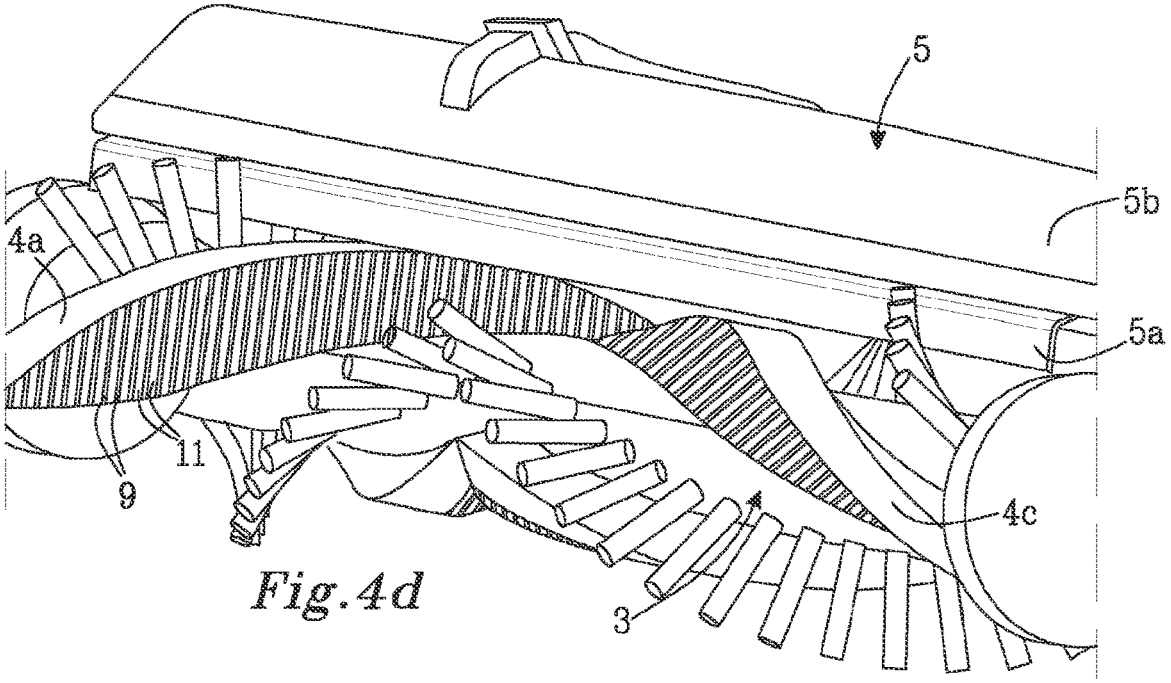

In FIG. 4*d* the cleaning member 5 is seen during cleaning of the rotatable member 3 of FIG. 4*c*. The resilient sheet member 5*a* of the cleaning member 5 will be in resilient contact with the support surface in a single contact point at segment 4*a*. If the resilient sheet member 5*a* is enabled to flex enough, a certain amount of contact may also be achieved at segment 4*c*. However, although some cleaning interaction may be performed at segment 4*c*, the majority of force applied to the cleaning member will be transferred to segment 4*a*. By such an arrangement, at least the most part of the force applied to the cleaning member 5 is focused to the contact with segment 4*a*. Contact in a single point, or at least in a limited area, ensure efficient cleaning while still not disturbing the normal cleaning operation.

A problem during cleaning of the brush roll is that entanglement around the brush roll seems not to be evenly spread along the length of the brush roll. Instead, entanglement is of greatest magnitude in the middle segment of the brush roll. Such uneven distribution of the entangled articles is disadvantageous from a brush roll cleaning perspective because cleaning of the top layers of entanglement are performed for each revolution of the brush roll, i.e. the more the layers of entangled articles at a specific segment the longer the total cleaning time. Therefore, the brush roll cleaning time is dependent on the maximum layers of entanglement at one specific segment of the brush roll. Therefore it is more beneficial if the total entanglement is spread out along the length of the brush roll. As seen from the FIGS. 4*a-d*, the rotatable member 3 comprises radial ribs 9 arranged perpendicular to the longitudinal axis 10 of the rotatable member 3. The radial ribs 9 extend from the rotatable member 3 to the projecting member creating multiple pockets 11 along the rotatable member 3. The multiple pockets 11 hinder entangled hairs etc. from wandering towards the middle segment. Thereby, a greater distribution of the entangled articles along the length of the brush roll is achieved, and the total brush roll cleaning time is reduced. Each pocket 11 catches and hinder particles like hair from wandering along the length of the brush roll.

Figure 5:
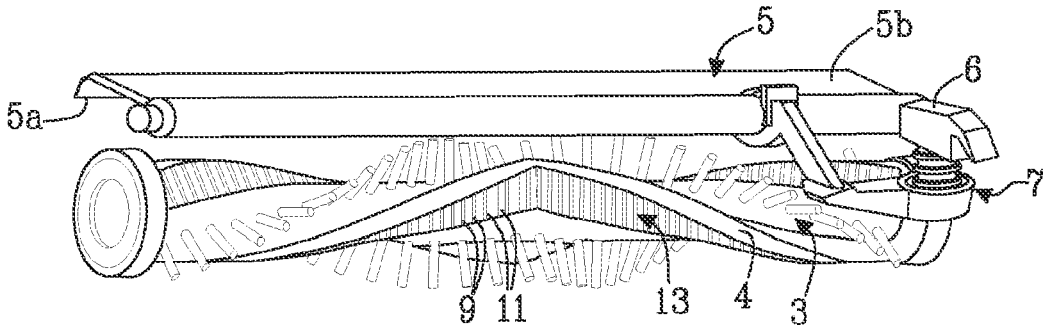
FIG. 5 illustrates a push button and a linking mechanism connected to the cleaning arrangement according to an embodiment.

FIG. 5 illustrates the push button 6 and the linking mechanism 7 connected to the cleaning arrangement according to an embodiment. The cleaning member 5 is moved from the resting position to the cleaning position by applying a pressing force to a push button 6 provided on the nozzle 1 at a surface turned towards a user. The cleaning member 5 is connected via a linking mechanism 7 shaft to the push button 6 on the nozzle 1.

Figure 6A:
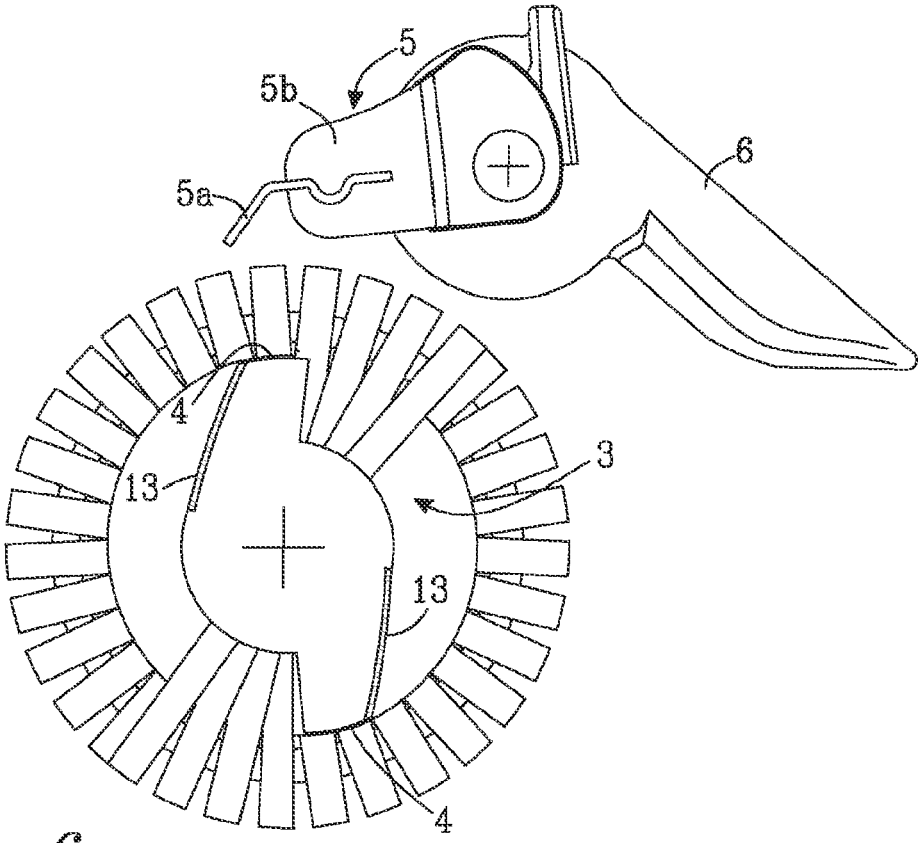
FIGS. 6*a* and 6*b* is a side view of the cleaning arrangement and the brush roll according to an embodiment.
Figure 6B:
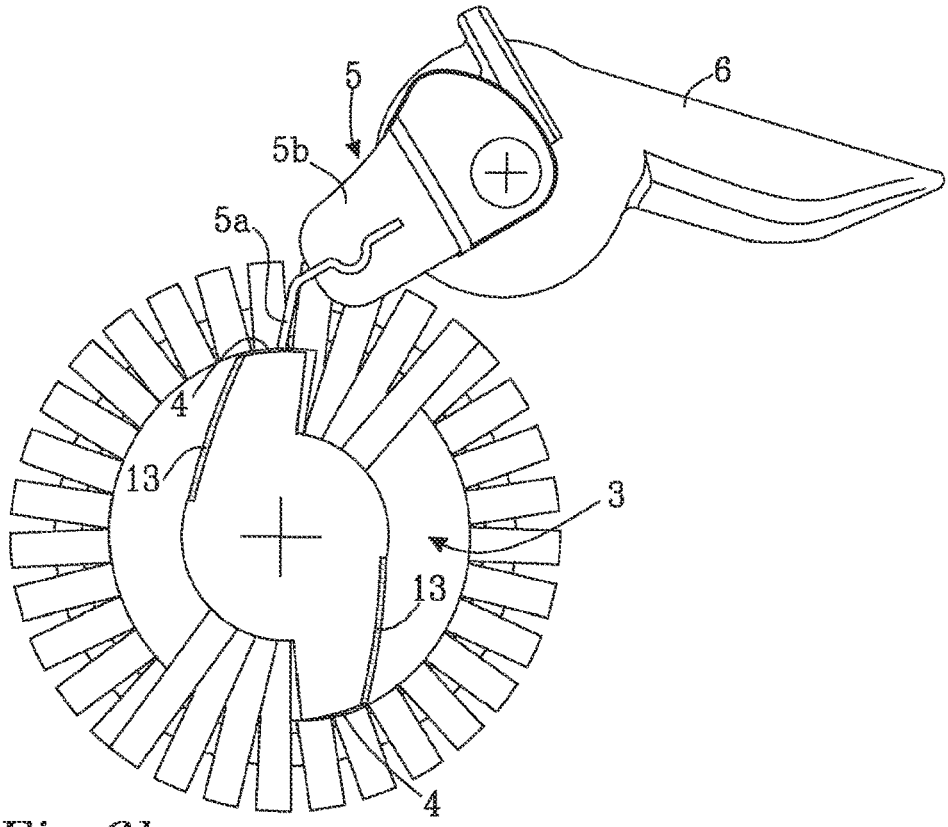

FIGS. 6*a* and 6*b* is a detailed side view of the cleaning arrangement and the brush roll according to an embodiment. In FIG. 6*a*, the cleaning member 5 is shown in a resting position. There is no contact between the resilient sheet member 5*a* and any parts of the rotating brush roll. In FIG. 6*b*, the cleaning member has been pivoted into a cleaning position. The resilient sheet member 5*a* is brought in the near vicinity of the rotating brush roll and a resilient contact is obtained between the resilient sheet member 5*a* and a support surface 4. The sharp edge of the resilient sheet member 5*a* will remove any articles entangled to the brush roll.

Figure 7A:
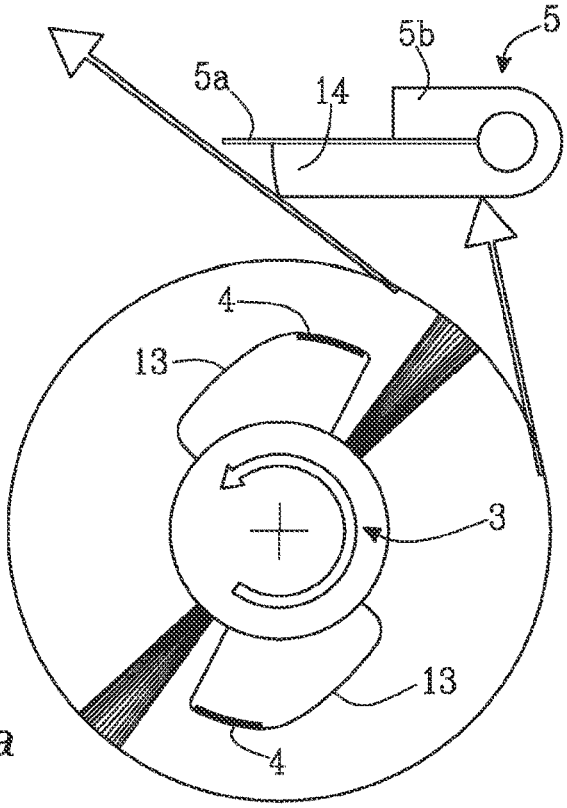
FIGS. 7*a* and 7*b* illustrate alternative arrangements in order to protect the cleaning arrangement and the brush roll with bristles from unnecessary wear when the cleaning arrangement is in a resting mode.
Figure 7B:
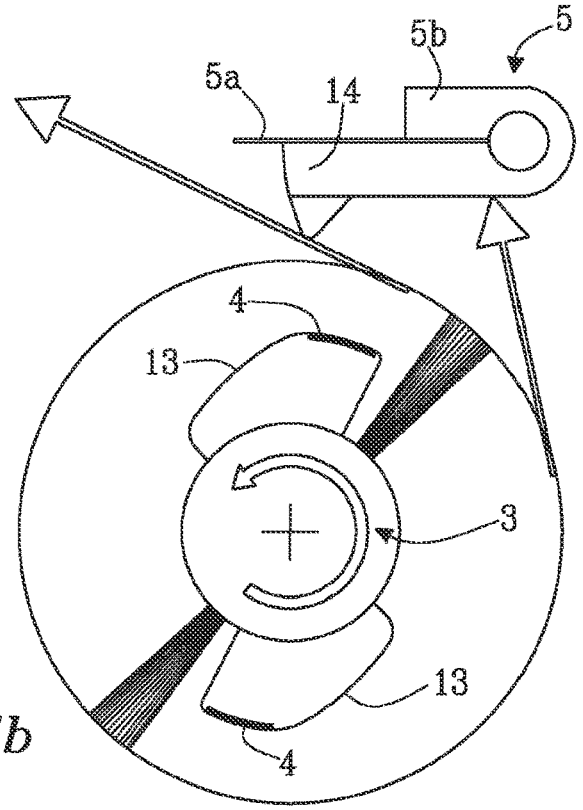

FIGS. 7*a* and 7*b* illustrate alternative arrangements in order to protect the brush roll from unnecessary wear when the cleaning arrangement is in a resting mode. The cleaning member 5 is designed to be protected from wear during normal vacuum cleaning, and also to help in minimizing the wear of the bristles during brush roll cleaning. Hard particles like small stones or the like cleaned up by the rotatable member 3 may contribute to wear of the cleaning member 5, and especially of the sharp edge. As seen in the drawings particles are prevented from contact with the cleaning member 5 by a protruding part 8 arranged faced to the rotatable member 3. Further, the protruding part 8 delimits wear of bristles on the brush roll due to contact between the bristles and the edge of the cleaning member 5. The bristles will first be in contact with the protruding part 8. Thereby, the bristles are bent before they get in contact with the edge and wear of the bristles are limited.

Figure 8:
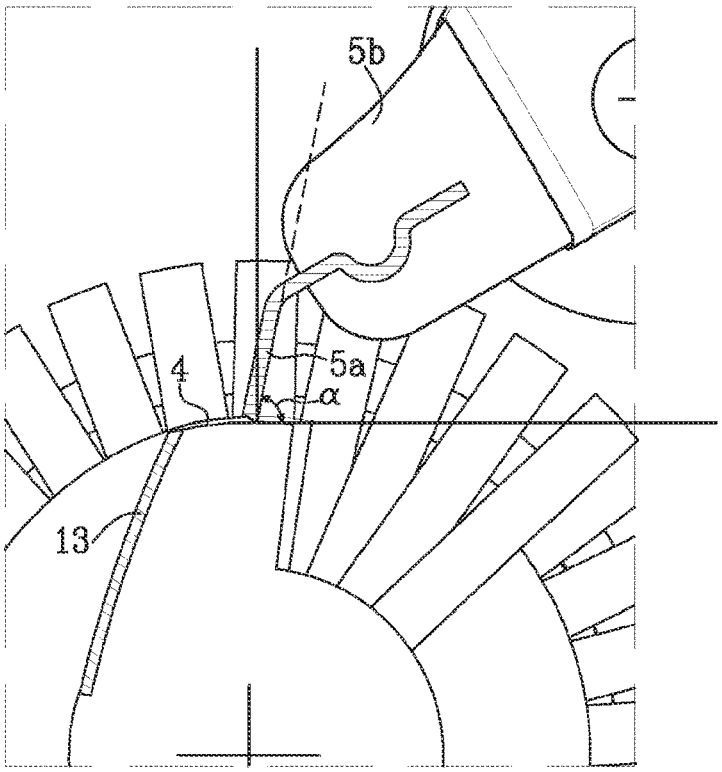
FIG. 8 shows details of the cleaning arrangement.

FIG. 8 show details of the cleaning arrangement. The resilient sheet member 5*a* of the cleaning member 5 when positioned in a cleaning position meets a tangent of a segment of the support surface 4 at an angle $\alpha$ which is in the range of 40°-90°.

When in use, the cleaning arrangement works as follows. During brush roll cleaning the cleaning member 5 will interact and apply pressure on a support surface 4 provided on a rotatable brush roll provided in the nozzle 1 of a vacuum cleaner. During the cleaning process, the motor fan of the vacuum cleaner is also turned on. The support surface 4 is the only area of the brush roll, apart from the bristles, that will be in contact with the cleaning member 5 during a cleaning process. For a full revolution of the brush roll, the entire support surface 4 will have been in contact with the cleaning member 5 and therefore will any entangled article be exposed to the cleaning interaction in between these parts. Entangled articles will get torn into smaller pieces by the tearing, or friction, caused by the cleaning member 5 at the support surface. These torn articles may be separated from the brush roll by the airflow of the vacuum cleaner in combination with centrifugal force due to the rotational movement of the brush roll and will end up in the dust container or dust bag of the vacuum cleaner. The bristles of the brush roll will flex below the cleaning member 5 during brush roll cleaning. Since it is the pressure that the cleaning member 5 applies on the surface of the support surface 4 that generates the majority of the tearing friction, the bristles will not be exposed to the same wear as the entangled articles. Further, since the resilient sheet member 5*a* is able to flex, a consistent interaction in between the resilient sheet member 5*a* and the support surface 4 during brush roll cleaning is achieved, which in turn will lower the tolerances. The brush roll cleaning performance is dependent on the rotational speed of the brush roll; the higher speed, the faster brush roll cleaning. Further on the speed is closely related to the torque; an increased torque will decrease the speed. It is therefore important to find a state were the applied torque is high enough for efficient brush roll cleaning whilst at the same time low enough to not decrease the speed too much.

The invention claimed is:

1. A nozzle for a vacuum cleaner, the nozzle comprising:

a rotatable member for picking up particles from a surface to be cleaned, the rotatable member being arranged to rotate around a longitudinal axis;

a cleaning arrangement operable for removing articles entangled on the rotatable member;

a nozzle cover that at least partly is made of transparent material such that the rotatable member is visible through the nozzle cover; and a light arranged proximate to the rotatable member for illuminating at least parts of the rotatable member, the light being operatively associated with the cleaning arrangement to illuminate the rotatable member when the cleaning arrangement is removing articles entangled on the rotatable member, wherein the cleaning member is moved from a resting position to a cleaning position by applying a pressing force to a push button on the nozzle at a surface facing a user, wherein the light is arranged to illuminate the rotatable member when a pressing force is applied to the push button and the cleaning member is moved from the resting position to the at least one cleaning position.

2. The nozzle according to claim 1, the cleaning arrangement comprising:

at least one support surface provided on at least one radially projecting member of the rotatable member; and at least one cleaning member being movable between the resting position in which the cleaning member is arranged at a distance from the support surface and the at least one cleaning position in the vicinity of the rotatable member in which the cleaning member, during rotation of the rotatable member, co-operates with at least one segment of the support surface to remove entangled articles from the rotatable member.

3. The nozzle according to of claim 2, wherein the at least one radially projecting member is helically arranged along a longitudinal axis of the rotatable member.

4. The nozzle according to claim 2, wherein the cleaning member is connected via a linking mechanism to the push button on the nozzle.

5. The nozzle according to claim 2, wherein the light is arranged to illuminate the rotatable member when the push button is fully pressed into an end position.

6. The nozzle according to claim 2, wherein the light is arranged to illuminate the rotatable member when the push button is pressed into an intermediate position.

7. The nozzle according to claim 1, wherein the cleaning member comprises a resilient sheet member capable of providing a resilient contact with at least one segment of the at least one support surface in the at least one cleaning position during rotation of the rotatable member.

8. The nozzle according to claim 7, wherein the resilient sheet member comprises a spring steel sheet.

9. The nozzle according to claim 8, wherein the spring steel sheet comprises a blade formed by stamping the sheet or machining the sheet.

10. The nozzle according to claim 1, wherein at least one protruding part is arranged on the nozzle at a surface facing the surface to be cleaned.

11. The nozzle according to claim 1, wherein the rotatable member comprises radial ribs arranged perpendicular to the longitudinal axis of the rotatable member.

12. The nozzle according to claim 11, wherein the radial ribs extend from the rotatable member to the at least one projecting member creating multiple pockets along the rotatable member.

13. A nozzle for a vacuum cleaner, the nozzle comprising:

a rotatable member for picking up particles from a surface to be cleaned, the rotatable member being arranged to rotate around a longitudinal axis;

a cleaning arrangement for removing articles entangled on the rotatable member; and a nozzle cover that at least partly is made of transparent material such that the rotatable member is visible through the nozzle cover;

wherein the cleaning member comprises a resilient sheet member capable of providing a resilient contact with at least one segment of the at least one support surface in the at least one cleaning position during rotation of the rotatable member, the resilient sheet member comprising a sheet of material having:

a blade portion that contacts the at least one segment of the at least one support surface in the at least one cleaning position during rotation of the rotatable member;

a mounting portion that is connected to a bar that movably mounts the resilient sheet member to the nozzle; and a bent portion that joins the blade portion to the mounting portion.

14. The nozzle according to claim 13, wherein the bent portion comprises a bend that is oriented parallel to the longitudinal axis.

15. A nozzle for a vacuum cleaner, the nozzle comprising:

a rotatable member for picking up particles from a surface to be cleaned, the rotatable member being arranged to rotate around a longitudinal axis;

a cleaning arrangement for removing articles entangled on the rotatable member; and a nozzle cover that at least partly is made of transparent material such that the rotatable member is visible through the nozzle cover;

wherein the rotatable member comprises a plurality of bristles provided in a pattern extending along a length of the rotatable member, and the cleaning arrangement comprises:

a blade mount pivotally connected to the nozzle adjacent and spaced from the rotatable member; and a blade extending along the length of the rotatable member and having a proximal end secured to the blade mount and a distal end spaced from the blade mount;

wherein the blade mount is rotatable between a first position in which the distal end of the blade does not contact the plurality of bristles as the rotatable member rotates, and a second position in which the distal end of the blade contacts the plurality of bristles as the rotatable member rotates.

16. The nozzle according to claim 15, wherein the plurality of bristles are in a helical pattern.

17. The nozzle according to claim 15, further comprising a push button provided on an outer surface of the nozzle and operatively connected to move the blade mount from the first position to the second position.

* * * * *